US010829338B2

(12) United States Patent
Bahlmann et al.

(10) Patent No.: US 10,829,338 B2
(45) Date of Patent: Nov. 10, 2020

(54) METHOD FOR OPERATING A WORKSTATION OF A SPINNING MACHINE OR WINDING MACHINE

(71) Applicant: Maschinenfabrik Rieter AG, Winterthur (CH)

(72) Inventors: Bernd Bahlmann, Schrobenhausen (DE); Romeo Pohn, Geisenfeld/Rottenegg (DE); Adalbert Stephan, Beilngries/Paulushofen (DE); Mario Maleck, Walting (DE); Robert Hagl, Rottenegg (DE); Evzen Pilar, Litomysl (CZ); Christian Kettner, Koesching (DE)

(73) Assignee: Maschinenfabrik Rieter AG, Winterthur (CH)

( * ) Notice: Subject to any disclaimer, the term of this patent is extended or adjusted under 35 U.S.C. 154(b) by 205 days.

(21) Appl. No.: 16/038,465

(22) Filed: Jul. 18, 2018

(65) Prior Publication Data

US 2019/0023522 A1 Jan. 24, 2019

(30) Foreign Application Priority Data

Jul. 19, 2017 (DE) ..... 10 2017 116 302

(51) Int. Cl.
*B65H 54/88* (2006.01)
*D01H 15/013* (2006.01)
(Continued)

(52) U.S. Cl.
CPC ..... *B65H 54/88* (2013.01); *B65H 51/16* (2013.01); *B65H 54/26* (2013.01); *B65H 67/04* (2013.01);
(Continued)

(58) Field of Classification Search
CPC ..... B65H 54/26; B65H 54/88; B65H 57/12; B65H 51/16; B65H 67/08; B65H 67/081;
(Continued)

(56) References Cited

U.S. PATENT DOCUMENTS 3,703,264 A * 11/1972 Winn, Jr. ..... B65H 51/16 242/129
4,920,739 A 5/1990 Raasch
(Continued)

FOREIGN PATENT DOCUMENTS

DE 37 34 565 A1 5/1989
DE 38 01 964 A1 7/1989
(Continued)

OTHER PUBLICATIONS

German Patent Office Search Report, dated Feb. 14, 2018.
EPO Search Report, dated Dec. 11, 2018.

*Primary Examiner* — Shaun R Hurley
(74) *Attorney, Agent, or Firm* — Dority & Manning, P.A.

(57) ABSTRACT

A method at a workstation of a spinning machine or winding machine supplies an auxiliary thread from a thread nozzle to a suction assigned to the workstation, the auxiliary thread stretched between the thread nozzle and the suction. The auxiliary thread is severed to form a thread section protruding into the suction and a thread section extending into the thread nozzle, wherein the thread section protruding into the suction is carried away by the suction. The thread section extending into the thread nozzle is grasped with a thread receiver such that the thread section extending into the thread nozzle extends between the thread nozzle and the thread receiver. The thread section extending into the thread nozzle is severed to form a thread section remaining in the thread nozzle and a thread section coming from the thread receiver. The thread section coming from the thread receiver is transferred to the suction of the workstation. The thread
(Continued)

section coming from the thread receiver is grasped with a capture arrangement adjacent a tube at the workstation prior to starting a process of winding the thread section coming from the thread receiver onto the tube.

14 Claims, 5 Drawing Sheets

(51) Int. Cl.

| | |
|---|---|
| ***B65H 54/26*** | (2006.01) |
| ***B65H 67/08*** | (2006.01) |
| ***B65H 69/00*** | (2006.01) |
| ***B65H 51/16*** | (2006.01) |
| ***D01H 4/48*** | (2006.01) |
| ***B65H 67/04*** | (2006.01) |
| ***D01H 4/44*** | (2006.01) |

(52) U.S. Cl.
CPC ..... *B65H 67/081* (2013.01); *B65H 67/085* (2013.01); *B65H 69/00* (2013.01); *D01H 4/44* (2013.01); *D01H 4/48* (2013.01); *D01H 15/013* (2013.01); *B65H 2701/31* (2013.01)

(58) Field of Classification Search
CPC ..... B65H 67/085; B65H 69/00; D01H 4/48; D01H 15/013
See application file for complete search history.

(56) References Cited

U.S. PATENT DOCUMENTS

| | | | | |
|---|---|---|---|---|
| 5,022,222 | A | 6/1991 | Rupert et al. | |
| 5,123,455 | A * | 6/1992 | Maina | B65H 51/16 139/452 |
| 5,369,946 | A * | 12/1994 | Pujol-Isern | D01H 1/08 57/312 |
| 5,473,879 | A | 12/1995 | Gobbels et al. | |
| 5,634,602 | A | 6/1997 | Göbbels et al. | |
| 5,676,322 | A | 10/1997 | Stahlecker | |
| 6,079,195 | A * | 6/2000 | Stahlecker | D01H 9/18 57/263 |
| 6,637,695 | B2 * | 10/2003 | Oehrl | B65H 63/036 242/475.5 |
| 2002/0023982 | A1 * | 2/2002 | Kargel | B65H 54/88 242/475.5 |
| 2003/0038205 | A1 | 2/2003 | Peuker | |
| 2016/0002830 | A1 * | 1/2016 | Stundl | D02G 1/122 28/267 |
| 2017/0029235 | A1 * | 2/2017 | Maleck | D01H 4/50 |
| 2017/0081142 | A1 * | 3/2017 | Maleck | B65H 67/04 |

FOREIGN PATENT DOCUMENTS

| | | | |
|---|---|---|---|
| DE | 43 13 523 | A1 | 10/1994 |
| DE | 44 43 818 | A1 | 6/1996 |
| DE | 195 17 690 | A1 | 11/1996 |
| DE | 101 41 046 | A1 | 3/2003 |
| DE | 10 2012 008 691 | A1 | 10/2013 |
| EP | 1 284 313 | A1 | 2/2003 |
| EP | 1 285 983 | A1 | 2/2003 |
| WO | WO 2009/033438 | A2 | 3/2009 |

* cited by examiner

METHOD FOR OPERATING A WORKSTATION OF A SPINNING MACHINE OR WINDING MACHINE

FIELD OF THE INVENTION

The present invention relates to a method for operating a workstation of a spinning machine or winding machine, a thread nozzle for making an auxiliary thread available at a workstation of a spinning machine or winding machine, a spinning machine or winding machine, as well as a service unit therefor.

BACKGROUND

DE 10 2012 008 691 A1 describes a method for operating workstations of an open-end rotor spinning machine and a corresponding workstation for carrying out the method, in which a first pivotably mounted suction nozzle and a second movably mounted suction nozzle are provided. The first pivotably mounted suction nozzle picks up a thread from a cross-wound bobbin and transfers the thread, in the area of the spinning device, to the workstation. When a predefined diameter of the cross-wound bobbin is reached, the winding process is interrupted and a cross-wound bobbin/tube change is initiated. In this case, the produced thread is disposed of by means of the second suction nozzle which can be positioned according to demand. The movably mounted second suction nozzle is positioned, during the transfer of the entering thread to an empty tube, in such a way that the thread can be held in the suitable position. It is disadvantageous in this case that two movably mounted suction nozzles are required. The design complexity of the mounting of the suction nozzles required therefor is considerable and requires a great deal of control effort. In addition, the movement of the suction nozzles is time-consuming and adversely affects the productivity of the workstation.

SUMMARY OF THE INVENTION

A task addressed by the present invention is that of providing a method, a workstation of a spinning machine or winding machine, a thread nozzle, as well as a service unit, which enable a simple and rapid piecing of a thread to an empty tube. Additional objects and advantages of the invention will be set forth in part in the following description, or may be obvious from the description, or may be learned through practice of the invention.

The task is solved by a method, a workstation, a thread nozzle, as well as a service unit having the features described herein.

The method according to the invention includes the following steps:

Initially, an auxiliary thread, i.e., a thread which is not spun by the workstation involved in the method or which is not supplied by a supply bobbin within the scope of the method, is supplied by a thread nozzle to a suction assigned to the workstation. The auxiliary thread can originate from an auxiliary-thread supply which is part of the thread nozzle or is connected thereto. The thread nozzle itself can be part of the workstation or of a service unit (also referred to as a service robot) that is displaceable along multiple workstations of the spinning machine or winding machine and that can carry out different service operations.

The thread nozzle is preferably connected to a source of compressed air and supplies the thread, with the aid of a pulse of compressed air, in the direction of the suction.

The suction is preferably part of the workstation and comprises an opening, via which one end of the auxiliary thread is drawn in. In any case, after the aforementioned end of the auxiliary thread has been grasped by the suction, the auxiliary thread extends between the thread nozzle and the suction and, therefore, is stretched between the thread nozzle and the suction.

In a step at a subsequent point in time, the auxiliary thread is severed, wherein the separation point preferably lies between the suction and the thread nozzle. In this method step, the auxiliary thread preferably stands still and is held by the suction and the thread nozzle.

The thread nozzle preferably comprises a pair of delivery rollers, by means of which the auxiliary thread can be transported, if necessary, in the direction of an opening of the thread nozzle, via which the auxiliary thread exits the thread nozzle. The pair of delivery rollers is simultaneously utilized for fixing the auxiliary thread in position in the thread nozzle when the rollers of the pair of delivery rollers stand still. This is preferably the case during the aforementioned severing of the auxiliary thread.

Preferably, the thread nozzle is immovable relative to the workstation or relative to the service unit and/or is fixed in position.

The severing of the auxiliary thread yields a section of the auxiliary thread projecting into the suction and a thread section extending into the thread nozzle, which, in turn, can be held by the pair of delivery rollers and preferably protrudes from the thread nozzle to some extent.

After the aforementioned severing of the auxiliary thread, the thread section projecting into the suction is completely drawn in and carried away with the aid of the suction, wherein the removal can take place, for example, via a vacuum channel extending across multiple workstations.

In contrast, the thread section extending into the thread nozzle is grasped by a thread receiver of the workstation. The thread receiver is, for example, a thread delivery unit. The thread delivery unit can be formed, for example, by a rotor or air-jet spinning unit of the workstation, which is known from the related art. In the case of a rotor spinning unit, the thread end of the thread section extending into the thread nozzle is introduced into the rotor housing of the rotor spinning unit with the aid of one or multiple thread-handling elements of the workstation or one of the service units assigned to the workstation at this moment and/or with the aid of an air flow. If, in a subsequent method step, the rotor spinning unit is fed via an opening roller with fibers of a sliver supplied to the opening roller and the rotor is set into rotation, the fibers accumulate on the thread end projecting into the rotor housing, and therefore a newly spun thread finally adjoins the auxiliary thread, the newly spun thread being continuously supplied by the rotor spinning unit.

If the thread receiver is an air-jet spinning unit, the aforementioned thread end is guided into or through the air-jet spinning nozzle of the air-jet spinning unit in order to be joined to a sliver. Subsequently, the auxiliary thread is drawn, together with the sliver joined thereto, into the air-jet spinning nozzle. A newly spun thread forms there as well, the first section of which is formed by the previously supplied auxiliary thread section.

The aforementioned thread section extending into the thread nozzle is therefore utilized as a piecing thread, to which fibers of a sliver supplied to the thread receiver are pieced, in the thread receiver, during the actual spinning process in order to subsequently continuously produce thread.

Alternatively, the thread receiver can also be a splicing or knotting unit of the workstation, with the aid of which the thread section extending into the thread nozzle is joined to a thread end of a thread coming from a supply bobbin of the workstation.

In the end, the auxiliary thread, which still extends into the thread nozzle after having been received by the thread receiver, extends between the thread nozzle and the thread receiver.

In the next step, the thread section extending into the thread nozzle is severed, wherein this can take place by means of a cutting unit of the workstation or of a service unit. Preferably, the cutting unit is part of the thread nozzle or is connected thereto. In any case, the result is a thread section remaining in the thread nozzle and a thread section coming from the thread receiver.

In the next step, the thread section coming from the thread receiver is supplied to the suction of the workstation, wherein, in this stage, a new thread section is already supplied by the thread receiver (as described above), which adjoins the thread section which was originally part of the auxiliary thread. In this stage, the thread present at the workstation extends between the thread receiver and the suction. Preferably, in this case, thread is constantly supplied by the thread receiver (for example, produced by the rotor or air-jet spinning position).

Subsequently, the thread section coming from the thread receiver is grasped with the aid of a capture arrangement and, as a result or subsequently, is brought into contact with a tube made available in a winding arrangement of the workstation. The capture arrangement is, for example, a brush plush partially enclosing the tube or a tube plate which comprises capture teeth and is situated in the area of an end face of the tube.

In order to facilitate the grasping of the thread section coming from the thread receiver by the capture unit, the thread section coming from the thread receiver can be deflected, with the aid of a thread deflector, in the direction of the tube. The thread deflector can be part of the thread nozzle.

Finally, the process of winding the thread supplied by the thread receiver onto the tube begins, wherein, in this case, the thread is guided in a traversing manner with the aid of a traversing, as is common in the related art. The method for laying a thread onto an empty tube has therefore been completed.

Particular advantages are achieved when the supply of the auxiliary thread from the thread nozzle to the suction takes place with the aid of a compressed-air flow generated by the thread nozzle. In this case, the auxiliary thread is preferably drawn off from an auxiliary-thread supply with the aid of the aforementioned pair of delivery rollers, wherein the beginning of the auxiliary thread is ejected from the thread nozzle with the aid of the compressed-air flow and is blown in the direction of the suction.

It is also extremely advantageous when the auxiliary thread is supplied by the thread nozzle, is subsequently grasped by a suction section of the workstation, and is only then drawn into the suction via the suction section. The suction section can be formed by a suction slot of the workstation, which is located, for example, in a housing of the workstation. In this case, the auxiliary thread extends from the thread nozzle into the suction section and, from there, into the suction which can be located, for example, within the housing and which is preferably not visible from the outside. For example, the suction section is located between the thread nozzle and a thread inlet of the suction, as viewed from the front of the workstation.

It is particularly advantageous when the auxiliary thread, before being severed, as described above, is deflected between the thread nozzle and the suction in the direction of the thread receiver with the aid of a thread manipulator. The thread manipulator is preferably capable of swiveling and can comprise a gripping section, for example, an eyelet or a hook, which is initially situated in a position, through which the auxiliary thread passes when the auxiliary thread extends from the thread nozzle into the suction. If the thread manipulator is subsequently moved, for example, swiveled, it deflects the auxiliary thread, and therefore the auxiliary thread subsequently forms a loop which extends between the thread nozzle, the thread manipulator, and the suction, wherein the auxiliary thread can additionally extend across the aforementioned suction section before entering the suction.

It is also advantageous when the aforementioned severing of the thread section extending into the thread nozzle takes place with the aid of a cutting unit of the thread nozzle within the thread nozzle, while the thread extends between the thread nozzle and the thread receiver. This yields the aforementioned thread section coming from the thread receiver and the likewise aforementioned thread section remaining in the thread nozzle, wherein the end of the latter-mentioned thread section remains in the thread nozzle. At the same time, the end of the thread section coming from the thread receiver is also located in the thread nozzle and can be deflected by the thread nozzle in the subsequent method step and transferred to the suction of the workstation. This transfer also preferably takes place with the aid of a compressed-air flow which is generated by the thread nozzle. Furthermore, it is possible in this case as well that the aforementioned end is drawn in via the above-described suction section and is only subsequently grasped by the suction.

In connection with the suction section, it is pointed out that the suction section can be fluidically connected to the suction in such a way that the air drawn in by the suction is drawn in via the suction section. The vacuum source of the suction section is therefore formed by the vacuum source connected to the suction.

It is also advantageous when the transfer of the thread section coming from the thread receiver to the suction of the workstation takes place with the aid of the thread nozzle. The thread section coming from the thread receiver is therefore deflected by the thread nozzle in the direction of the suction, wherein this can take place by means of the aforementioned compressed-air flow of the thread nozzle. Subsequent thereto, the thread section coming from the thread receiver extends from the thread receiver via the thread nozzle to the suction. The aforementioned thread section can extend, in this case, between the thread nozzle and the suction, through the above-described suction section of the workstation.

It is also advantageous when the thread section coming from the thread receiver enters the thread nozzle via a first opening of the thread nozzle and exits the thread nozzle via a second opening of the thread nozzle. The thread section coming from the thread receiver extends through the thread nozzle in this case. In particular, the auxiliary thread is delivered to the suction via the first opening at the beginning of the method. Before the thread section coming from the thread receiver is severed in the area of the thread nozzle, the aforementioned thread section finally enters the thread nozzle via the first opening. The thread section forming after the severing, which extends from the thread receiver via the thread nozzle to the suction, also enters the thread nozzle via the first opening and exits the thread nozzle via the second opening.

Particular advantages are achieved when the thread section coming from the thread receiver is joined to a fiber material of a sliver delivered to the thread receiver with the aid of the thread receiver. A corresponding piecing process can take place by way of the end of the aforementioned thread section being introduced or drawn into a rotor spinning unit forming the thread receiver and, there, being brought into contact with individual fibers of the sliver while the rotor of the rotor spinning unit is rotating.

If the thread receiver is an air-jet spinning unit, the thread end is brought into contact with the sliver before it enters the air-jet spinning unit and is drawn into the air-jet spinning unit together with the sliver.

It is also conceivable that the thread receiver is a splicing or knotting unit of the workstation of a winding machine. The splicing or knotting unit joins one end of a thread coming from a supply bobbin to the thread section coming from the thread receiver before the thread section coming from the thread receiver is transferred to the suction of the workstation.

Furthermore, the thread receiver can also be formed, of course, by the splicing or knotting unit of an air-jet spinning machine.

It is also extremely advantageous when the thread nozzle is a component of a service unit which is mounted so as to be displaceable along multiple workstations of the spinning machine or winding machine. In addition, the auxiliary thread should be made available by the service unit which can comprise an auxiliary-thread supply, for example, an auxiliary-thread bobbin, for this purpose.

Furthermore, the invention relates, in general, to a thread nozzle for making an auxiliary thread available at a workstation of a spinning machine or winding machine. The thread nozzle can be a component of a service unit or can also be fixed in position on a frame or any other type of holding arrangement of a workstation of a spinning machine or winding machine. The thread nozzle comprises at least one first opening and one second opening, wherein both openings are utilized for the exit and/or the entry of an auxiliary thread.

Furthermore, the thread nozzle comprises a compressed-air inlet including a connector for a compressed-air supply in order to blow an auxiliary thread out of the thread nozzle through the first or the second opening and, as described above, in the direction of a suction of a workstation of a spinning machine or winding machine.

In order to be able to influence the course of the auxiliary thread, the thread nozzle also comprises a valve, with the aid of which it can be established which of the two openings is the exit from the thread nozzle for air introduced via the connector for the compressed-air supply.

The valve preferably comprises a connector, via which the valve can be connected to a control of a service unit or the aforementioned workstation or to a control of the spinning machine or winding machine comprising the workstation in order to be able to automatically control the position of the valve. The valve is preferably a multi-way valve, with the aid of which it can be established whether the compressed air introduced into the valve flows out of the air nozzle via the first or the second opening.

Finally, it is advantageous when the thread nozzle comprises a pair of delivery rollers, with the aid of which an auxiliary thread can be supplied by an auxiliary-thread supply, which can also be part of the thread nozzle, in the direction of the valve. With the aid of the pair of delivery rollers, the auxiliary thread can therefore either be moved or, if the rollers of the pair of delivery rollers come to a standstill, are fixed in position.

It is also advantageous when the thread nozzle comprises at least one cutting unit, with the aid of which the auxiliary thread can be severed. The cutting unit is preferably arranged in the transport path of the auxiliary thread between the pair of delivery rollers and the valve. If an auxiliary thread is severed, a first section extends between the delivery rollers, while the end of the second section of the auxiliary thread forms between the valve and the cutting unit.

Moreover, the invention relates to a service unit for a spinning machine or winding machine for carrying out service steps, in the case of which an auxiliary thread is delivered to a tube of the workstation. In particular, the method described in the preceding and/or in the following can be carried out with assistance from the service unit. The service unit is distinguished by the fact that it comprises a thread nozzle according to the preceding and/or the following description.

Finally, a spinning machine or winding machine for manufacturing or for rewinding a yarn is part of the invention and is distinguished by the fact that it comprises a thread nozzle according to the preceding and/or the following description. The thread nozzle can be assigned to one or multiple workstations and is preferably fixed in position on a frame or any other type of holding arrangement of the spinning machine or winding machine. Alternatively, it is part of a service unit.

Preferably, the spinning machine is a rotor spinning machine or an air-jet spinning machine known from the related art. A winding machine is a textile machine which is also known from the related art, with the aid of which a thread from a supply bobbin (which originates, for example, from a ring spinning machine) is rewound onto a tube, wherein thread defects which are present are removed.

BRIEF DESCRIPTION OF THE DRAWINGS

Further advantages of the invention are described in the following exemplary embodiments, wherein.

DETAILED DESCRIPTION

Figure 1:
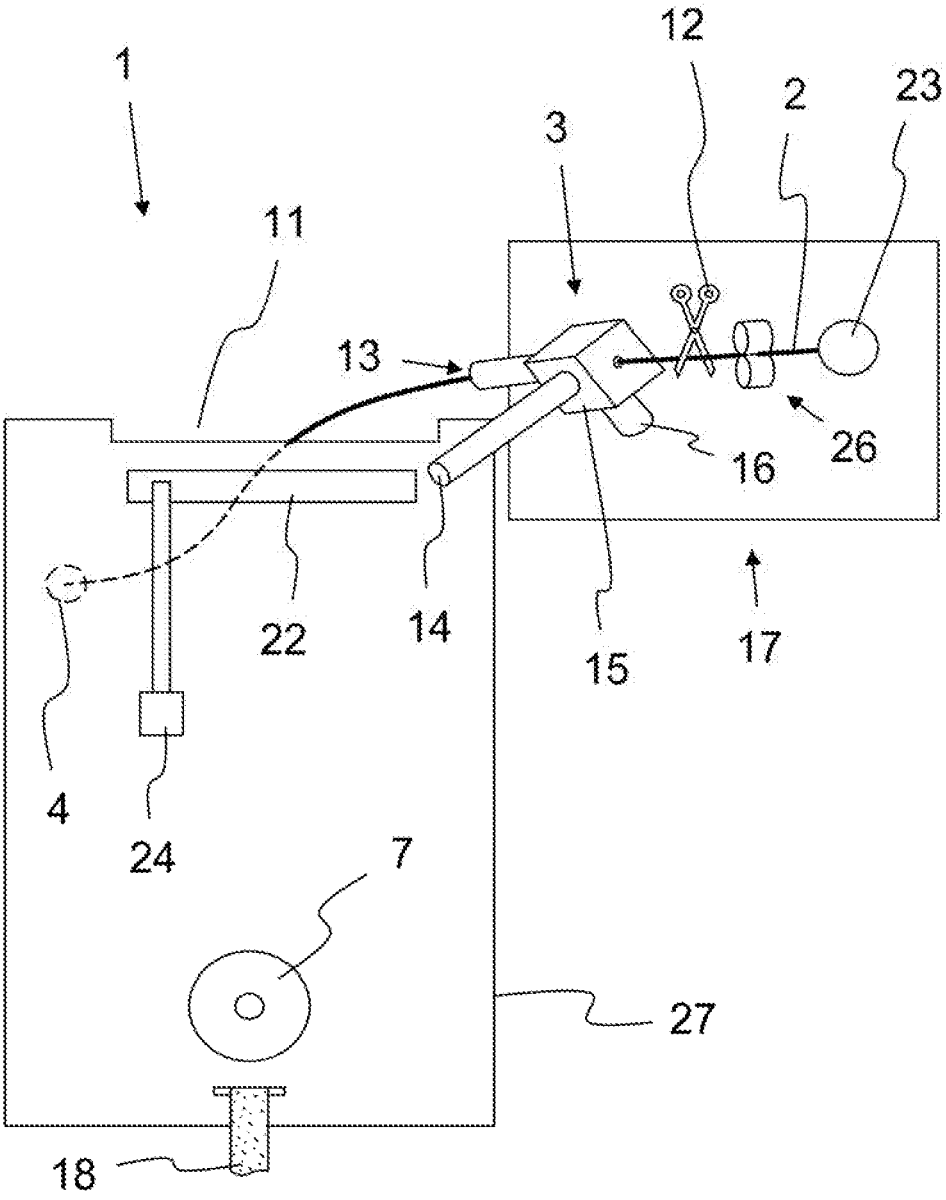
FIG. 1 is a front view of a workstation of a rotor spinning machine comprising a thread nozzle.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIGS. 1 through 5 show, in general, a workstation 1 of a spinning machine or winding machine. Only the sections and components which are important for the understanding of the invention are represented. The workstation 1 comprises further elements, of course, such as a holder (not shown) for the tube 25 shown in FIG. 5 and a corresponding tube drive. In addition, not all the sections shown in FIG. 1 are shown in all figures, such as the compressed-air inlet 16 of the above-described valve 15 of the thread nozzle 3, even though they are actually present.

It is also pointed out that the figures show a piecing of a thread onto a tube 25, which can be applied, in principle, on a spinning machine or also on a winding machine. The thread nozzle 3 described in the following can also be utilized on both types of textile machines.

Figure 2:
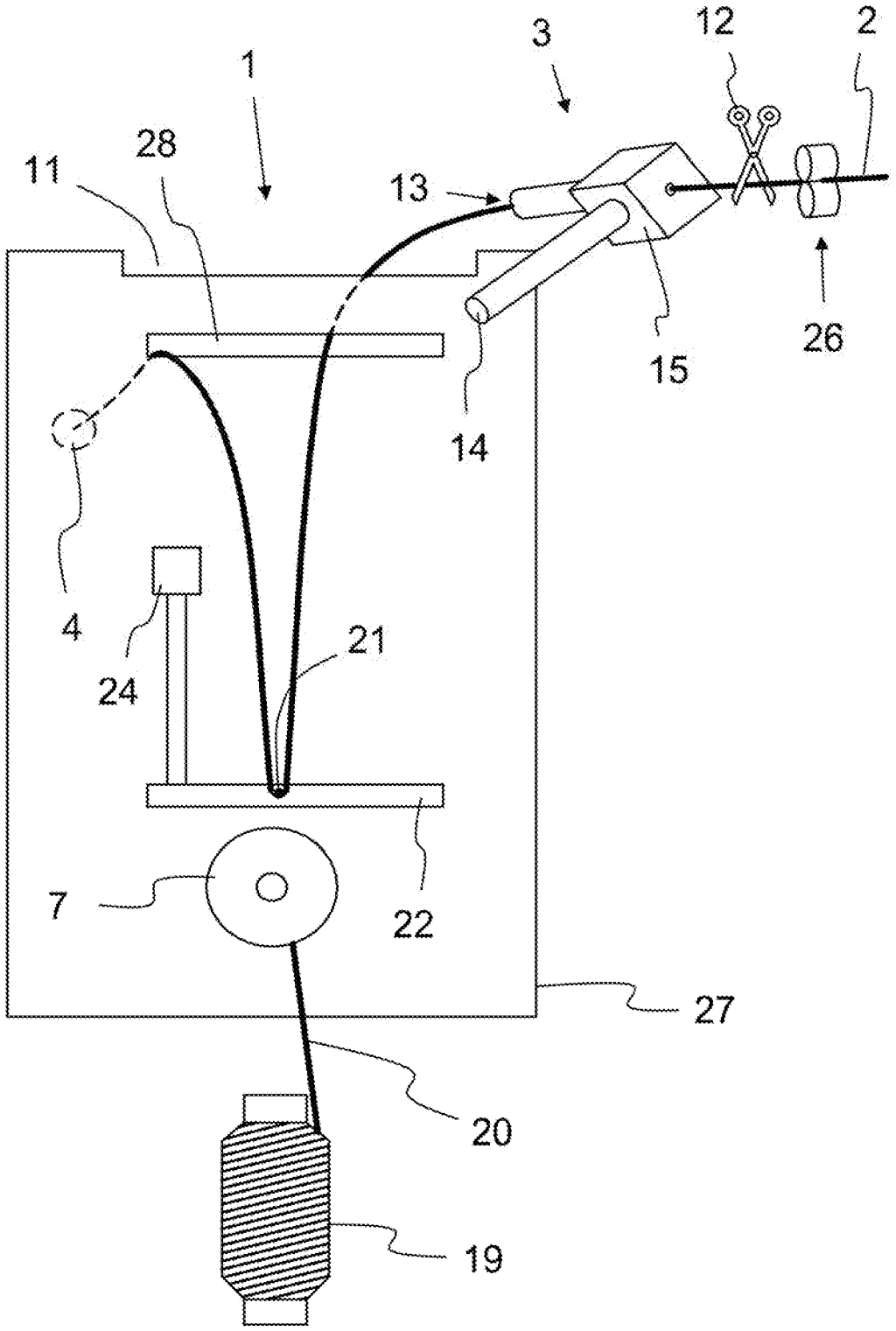
FIG. 2 is a front view of a workstation of a winding device comprising a thread nozzle.

Purely by way of example, therefore, the feeding of a sliver 18 into the thread receiver 7 is shown in FIG. 1. The thread receiver is described in greater detail in the following and is designed as a rotor spinning unit in this case. FIG. 2 shows, also by way of example, that the machine can also be a winding machine, in which a thread 20 coming from a supply bobbin 19 is rewound onto a tube 25 which is shown exclusively in FIG. 5. In this case, within the scope of the method, the end of the thread 20 coming from the supply bobbin 19 is joined to an auxiliary thread 2 coming from above within a splicing or knotting unit which forms the thread receiver 7 in this case.

The individual steps of one advantageous embodiment of the method according to the invention is described in the following, which is utilized, in general, for bringing a thread into contact with an empty tube 25 in order to start a winding process of a thread supplied by the thread receiver 7 onto the tube 25. A corresponding method can be carried out, for example, after the workstation 1 has completely loaded a tube 25 with a thread and the full bobbin must be replaced by an empty tube 25.

Figure 5:
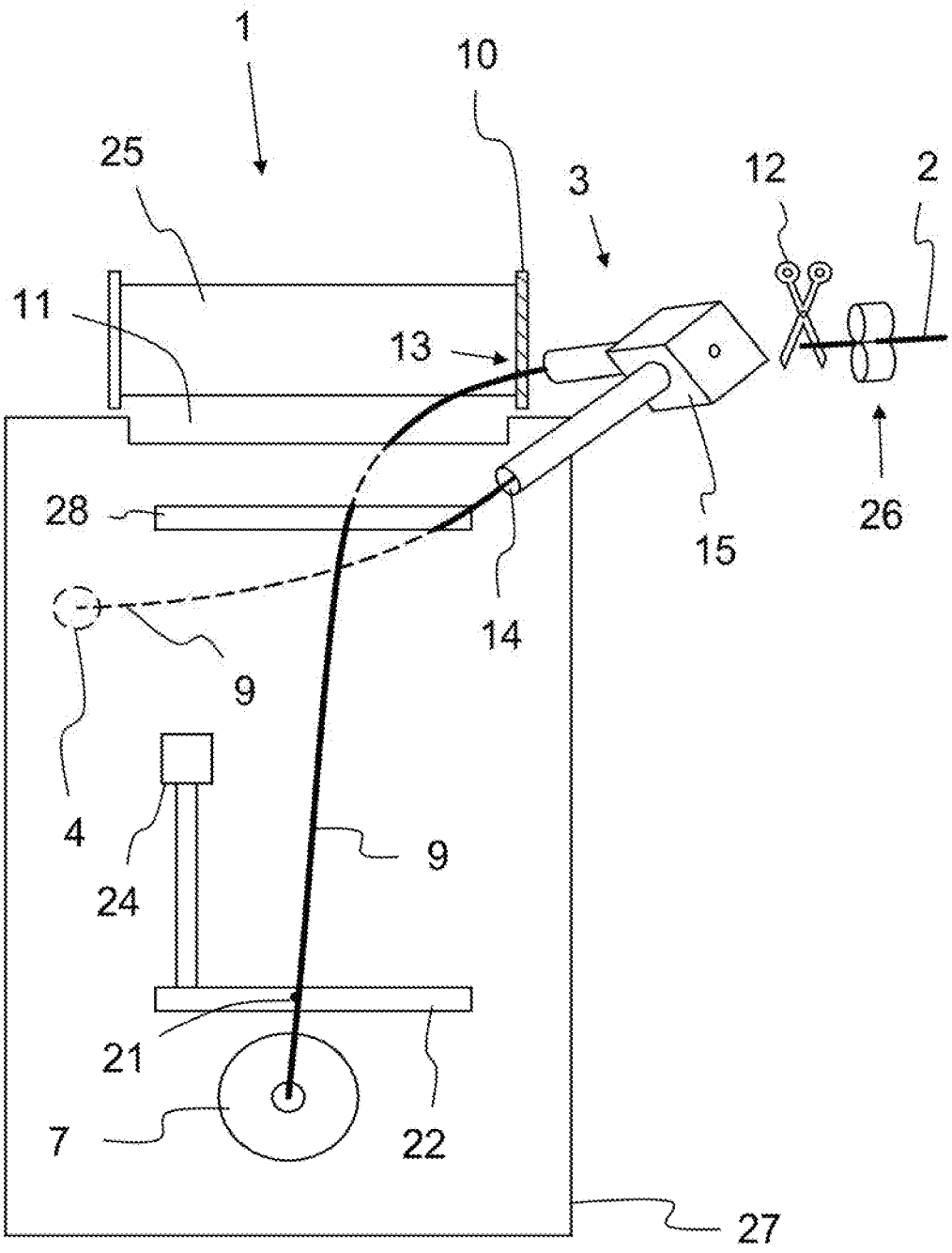

Furthermore, it is pointed out that the empty tube 25 is first shown in FIG. 5. The tube 25 can also be made available to the workstation 1 at an earlier point in time, of course.

At the beginning of the method, an auxiliary thread 2 is made available by an auxiliary-thread supply 23 (for example, an auxiliary-thread bobbin). The auxiliary-thread supply 23 can be part of the thread nozzle 3, which is described in the following, or can merely be assigned thereto. The auxiliary thread 2 is preferably supplied to a valve 15 of the thread nozzle 3 with the aid of a pair of delivery rollers 26 (which can also be part of the thread nozzle 3). For example, the auxiliary thread 2 can be drawn into the valve 15 by means of an air flow. The air flow can arise, according to the venturi principle, by way of compressed air, which has been introduced into the valve 15 via a compressed-air inlet 16 of the thread nozzle 3, exiting the thread nozzle 3 via a first opening 13.

The thread nozzle 3, the pair of delivery rollers 26, the auxiliary-thread supply 23, and the cutting unit 12 described in the following can be components of a service unit 17 patrolling along multiple workstations 1. It is also conceivable that the aforementioned elements are part of the workstation 1.

In any case, the auxiliary thread 2 is supplied by the thread nozzle 3 to a suction 4 assigned to the workstation 1, wherein the suction 4 is preferably part of the workstation 1 and can be situated behind a housing 27 of the workstation 1 or a cover. In addition, the suction 4 is connected to a vacuum source, and therefore the suction 4 has a suctioning effect on the auxiliary thread 2.

As FIG. 1 shows, it is advantageous when the auxiliary thread 2 is not drawn directly into the suction 4. Instead, the auxiliary thread 2 should be initially drawn in by a suction section 11 which can be designed, for example, as a slot or any other type of opening in the housing 27. Finally, extending behind the suction section 11 is a flow connection (not shown) to the suction 4, and therefore the auxiliary thread 2 is drawn into the suction 4 via the suction section 11.

In the end, the auxiliary thread 2 is finally stretched between the thread nozzle 3 and the suction 4.

Furthermore, the sections of the auxiliary thread 2 which are visible from the outside are represented in the figures by a solid line, wherein the sections which are not visible from the outside are dashed.

In the next step, the auxiliary thread 2 is deflected downward with the aid of a thread manipulator 22, wherein, for this purpose, the thread manipulator 22 is swiveled about a swivel axis with the aid of a pivot bearing 24 (FIG. 2).

In order to correspondingly deflect the thread, the thread manipulator 22 comprises a gripping section 21, for example, in the form of an eyelet or a hook. The gripping section 21 can also be in contact with the auxiliary thread 2 in the stage shown in FIG. 1 and holds the auxiliary thread 2 when the thread manipulator 22 is swiveled.

At the same time, the thread manipulator 22 uncovers an inlet opening 28 by means of the swiveling, and therefore the auxiliary thread 2 coming from the thread nozzle 3 is drawn in via the suction section 11, extends behind a housing 27 or any other type of cover, and exits the inlet opening 28. Subsequently, the auxiliary thread 2 extends over the gripping section 21, from there back into the inlet opening 28 and, finally, into the suction 4. The auxiliary thread 2 therefore assumes the course shown in FIG. 2 after the thread manipulator 22 has swiveled.

Subsequent thereto in terms of time, the auxiliary thread 2 is severed in the area which had been previously deflected. The severing can take place by means of a device (not shown) for the preparation of thread ends, which can be located in the area of the thread receiver 7.

In any case, the severing yields a thread section 5 (FIG. 3) protruding into the suction 4 and a thread section 6 which extends into the thread nozzle 3 and is still fixed in position by the pair of delivery rollers 26.

Figure 3:
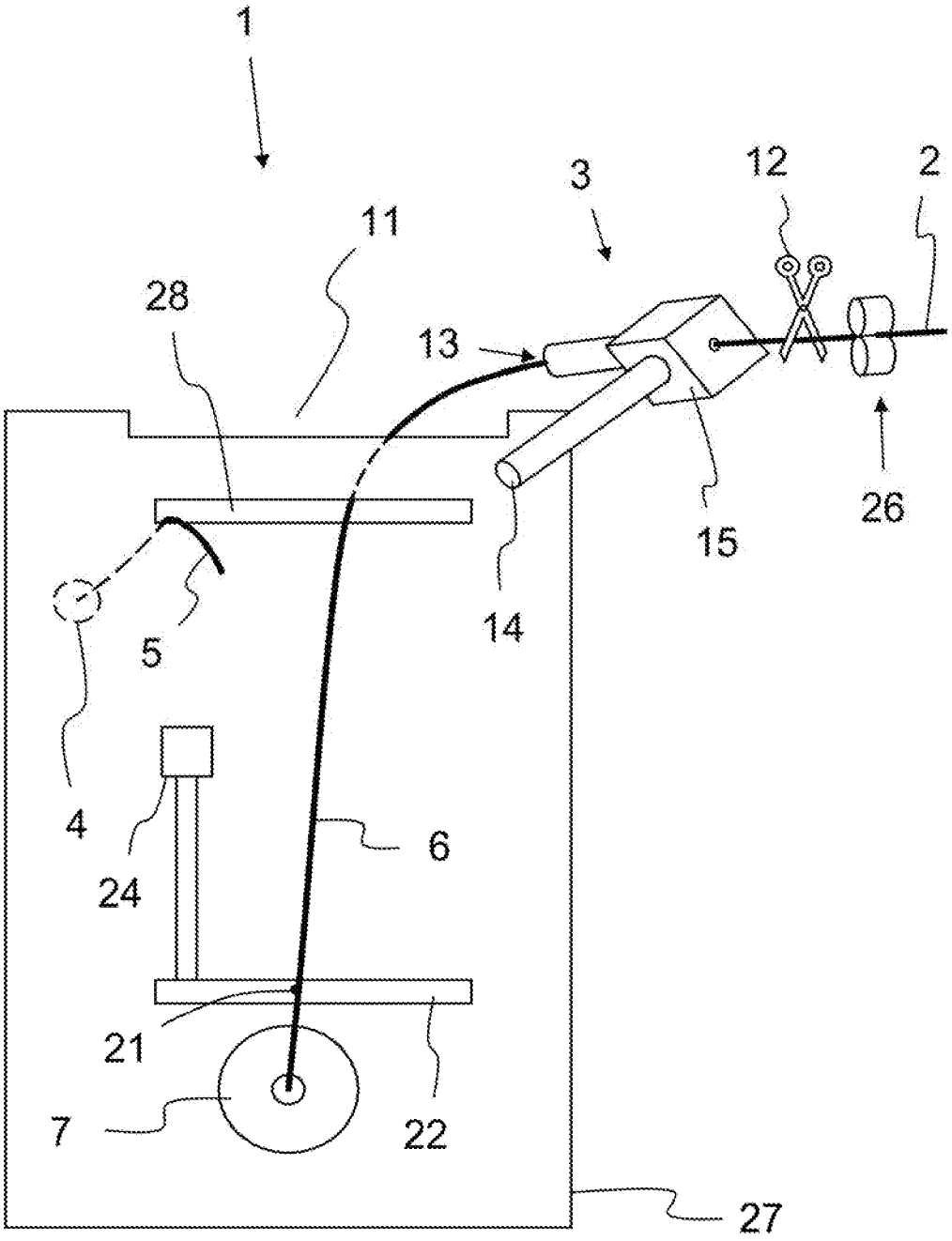
FIGS. 3 through 5 are front views of a workstation of a spinning machine or winding machine comprising a thread nozzle.

While the thread section 5 protruding into the suction 4 is carried away with the aid of the suction 4, the thread section 6 extending into the thread nozzle 3 is grasped by the thread receiver 7 of the workstation 1, which can be a rotor or air-jet spinning unit of a spinning machine or a thread joining unit (splicing or knotting unit) of a winding machine or a spinning machine. In the end, the thread section 6 extending into the thread nozzle 3 extends between the thread nozzle 3 and the thread receiver 7, as shown in FIG. 3.

Figure 4:
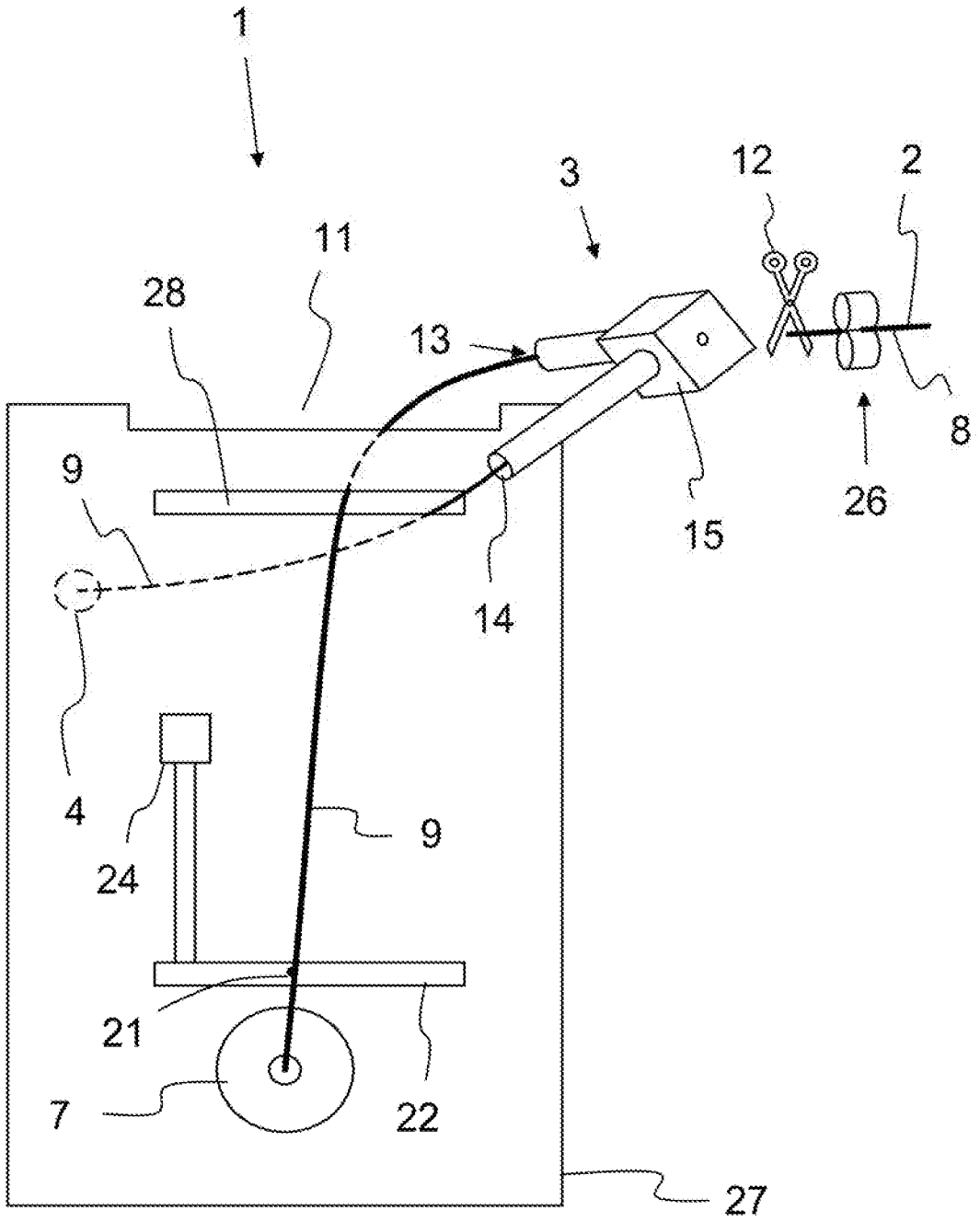

Subsequently, the thread section 6 extending into the thread nozzle 3 is severed, thereby yielding a thread section 8 remaining in the thread nozzle 3 and a thread section 9 coming from the thread receiver 7 (FIG. 4). The severing can take place, for example, with the aid of a cutting unit 12 of the thread nozzle 3.

In the next step, the valve 15 of the thread nozzle 3 is controlled in such a way that the air flowing in via the compressed-air inlet 16 flows outward via a second opening 14 of the thread nozzle 3. Due to the venturi principle, air is simultaneously drawn in via the first opening 13. Due to the air flow, the thread section 9 coming from the thread receiver 7 is output via the second opening 14 and is drawn into the effective area of the suction section 11 which finally draws in the aforementioned thread section. After passing through the suction section 11, this thread section is drawn into the suction 4. The thread section 9 coming from the thread receiver 7 is therefore transferred to the suction 4 of the workstation 1. The resultant course of the thread section 9 coming from the thread receiver 7 is shown in FIG. 4, wherein the thread receiver 7 already supplies new thread here, which is produced either with the aid of a rotor or air-jet spinning unit or originates from a supply bobbin 19 which is not shown in FIG. 4.

Subsequently, the thread section 9 coming from the thread receiver 7 is grasped in the area between the suction section 11 and the first opening 13 and, therefore, in the area of a tube 25 made available by the workstation 1, with the aid of a capture arrangement 10. The capture arrangement 10 can be, for example, one or multiple capture teeth of a tube plate holding the tube 25 or a brush plush of the tube 25.

In order to facilitate the grasping, the thread nozzle 3 can comprise a deflection element (not shown), with the aid of which the thread section 9 coming from the thread receiver 7 can be deflected in the direction of the capture arrangement 10.

After the thread section 9 coming from the thread receiver 7 has been grasped by the tube 25 or the capture arrangement 10, the thread section is severed between the capture arrangement 10 and the first opening 13, and therefore the thread subsequently supplied by the thread receiver 7 can be wound onto the tube 25, while the remaining section is carried away by the suction 4.

Finally, the process of winding the thread section 9 coming from the thread receiver 7 onto the tube 25 is started, as is known from the related art. In particular, the thread section 9 coming from the thread receiver 7 is guided in a laterally traversing manner during the winding onto the tube 25.

The present invention is not limited to the exemplary embodiments which have been represented and described. Modifications within the scope of the claims are also possible, as is any combination of the described features, even if they are represented and described in different parts of the description or the claims or in different exemplary embodiments, provided no contradiction to the teaching of the independent claims results.

REFERENCE CHARACTERS

1 workstation of a spinning machine or winding machine
2 auxiliary thread
3 thread nozzle
4 suction
5 thread section protruding into the suction
6 thread section extending into the thread nozzle
7 thread receiver
8 thread section remaining in the thread nozzle
9 thread section coming from the thread receiver
10 capture arrangement
11 suction section
12 cutting unit of the thread nozzle
13 first opening of the thread nozzle
14 second opening of the thread nozzle
15 valve
16 compressed-air inlet of the thread nozzle
17 service unit
18 sliver
19 supply bobbin
20 thread coming from the supply bobbin
21 gripping section
22 thread manipulator
23 auxiliary-thread supply
24 pivot bearing
25 tube
26 pair of delivery rollers
27 housing
28 inlet opening

The invention claimed is:

1. A method for operating a workstation of a spinning machine or winding machine, comprising:

supplying an auxiliary thread from a thread nozzle to a suction assigned to the workstation, wherein the auxiliary thread is stretched between the thread nozzle and the suction;

severing the auxiliary thread to form a thread section protruding into the suction and a thread section extending into the thread nozzle, wherein the thread section protruding into the suction is carried away by the suction;

grasping the thread section extending into the thread nozzle with a thread receiver of the workstation, wherein the thread section extending into the thread nozzle extends between the thread nozzle and the thread receiver;

severing the thread section extending into the thread nozzle to form a thread section remaining in the thread nozzle and a thread section coming from the thread receiver;

transferring the thread section coming from the thread receiver to the suction of the workstation; and grasping the thread section coming from the thread receiver with a capture arrangement in an area of a tube made available by the workstation and starting a process of winding the thread section coming from the thread receiver onto the tube.

2. The method as in claim 1, wherein the auxiliary thread is supplied from the thread nozzle to the suction with a compressed-air flow generated by the thread nozzle.

3. The method as in claim 1, wherein the auxiliary thread is supplied by the thread nozzle, is subsequently grasped by a suction section of the workstation, and is drawn into the suction via the suction section.

4. The method as in claim 1, wherein before the severing of the auxiliary thread, the auxiliary thread is deflected towards the thread receiver by a movable thread manipulator.

5. The method as in claim 1, wherein the severing of the thread section extending into the thread nozzle is done with a cutting within the thread nozzle.

6. The method as in claim 1, wherein the transfer of the thread section coming from the thread receiver to the suction is done with the thread nozzle, wherein after the transfer, the thread section coming from the thread receiver extends from the thread receiver via the thread nozzle to the suction.

7. The method as in claim 1, wherein the thread section coming from the thread receiver enters the thread nozzle via a first opening of the thread nozzle and exits the thread nozzle via a second opening of the thread nozzle such that the thread section coming from the thread receiver extends through the thread nozzle.

8. The method as in claim 1, wherein after the severing of the thread section extending into the thread nozzle, the thread section coming from the thread receiver is joined in the thread receiver to a fiber material of a sliver delivered to the thread receiver or to a thread coming from a supply bobbin before the thread section coming from the thread receiver is transferred to the suction.

9. The method as in claim 1, wherein the thread nozzle is a component of a service unit that is displaceable along multiple workstations of the spinning machine or winding machine, and the auxiliary thread is made available by the service unit.

10. A thread nozzle for making an auxiliary thread available at a workstation of a spinning machine or winding machine, comprising:

a first opening configurable between an outlet or an inlet for the auxiliary thread;

a second opening configurable between an outlet or an inlet for the auxiliary thread;

a compressed air inlet; and a controllable multi-way valve in direct communication with the first opening, the second opening, and the compressed air inlet, the multi-way valve controlled to change position to establish which of the first or second openings is an exit for compressed air from the thread nozzle thereby defining the outlet and the inlet for the auxiliary thread.

11. The thread nozzle as in claim 10, further comprising a pair of delivery rollers configured such that the auxiliary thread extending into or through the thread nozzle is held in position or moved by the delivery rollers.

12. The thread nozzle as in claim 10, further comprising a cutting unit disposed so as to sever the auxiliary thread.

13. A service unit for a spinning machine or winding machine for delivering an auxiliary thread to a tube made available at a workstation of a spinning machine or a winding machine, wherein the service unit comprises the thread nozzle in accordance with claim 10.

14. A workstation of a spinning machine or winding machine for manufacturing or for rewinding a yarn, comprising the thread nozzle in accordance with claim 10 assigned to one or multiple workstations of the spinning machine or winding machine.

* * * * *